US009957149B2

(12) United States Patent
Park et al.

(10) Patent No.: US 9,957,149 B2
(45) Date of Patent: May 1, 2018

(54) BEVERAGE CONTAINER FOR INJECTING BEVERAGE THROUGH BOTTOM THEREOF

(71) Applicant: NPC Co., Ltd., Asan-si (KR)

(72) Inventors: Suk Joong Park, Seoul (KR); Si Haeng Lee, Seoul (KR)

(73) Assignee: NPC Co., Ltd., Ansan-si, Gyeonggi-do (KR)

( * ) Notice: Subject to any disclaimer, the term of this patent is extended or adjusted under 35 U.S.C. 154(b) by 0 days. days.

(21) Appl. No.: 15/104,416

(22) PCT Filed: Nov. 13, 2014

(86) PCT No.: PCT/KR2014/010904
§ 371 (c)(1),
(2) Date: Jun. 14, 2016

(87) PCT Pub. No.: WO2016/006771
PCT Pub. Date: Jan. 14, 2016

(65) Prior Publication Data
US 2017/0001853 A1 Jan. 5, 2017

(30) Foreign Application Priority Data
Jul. 9, 2014 (KR) ..... 10-2014-0085888

(51) Int. Cl.
*B67D 7/02* (2010.01)
*B65D 47/06* (2006.01)
(Continued)

(52) U.S. Cl.
CPC ..... *B67D 7/0288* (2013.01); *A47G 19/2205* (2013.01); *B65D 47/06* (2013.01);
(Continued)

(58) Field of Classification Search
CPC .... A47G 19/2205; B65D 47/06; B65D 47/20; B65D 53/02; B65D 55/02; B65D 7/42;
(Continued)

(56) References Cited

U.S. PATENT DOCUMENTS 8,763,655 B2 7/2014 Springer ..... 141/113
2008/0017256 A1* 1/2008 Thomas ..... F16K 15/023 137/529
(Continued)

FOREIGN PATENT DOCUMENTS

JP 10-160014 6/1998 ..... F16K 15/16
JP 2014-040277 A 3/2014 ..... B65D 25/20
(Continued)

OTHER PUBLICATIONS

International Searching Authority, International Search Report—International Application No. PCT/KR2014/010904, dated Dec. 10, 2014, 2 pages.

*Primary Examiner* — Timothy L Maust
*Assistant Examiner* — Andrew Schmid
(74) *Attorney, Agent, or Firm* — Sunstein Kann Murphy & Timbers LLP

(57) ABSTRACT

A beverage container has a body having an inlet which is formed so as to penetrate the bottom of a receiving unit. A holder is coupled to the inlet to open and close the inlet upon ascending or descending with a nozzle of a beverage supply device being inserted into the holder. A locking member is coupled to the ascending/descending wall of the holder to allow the holder to close the inlet. The locking member has a plurality of elastic arms for elastically supporting the holder.

6 Claims, 6 Drawing Sheets

(51) Int. Cl.

| | |
|---|---|
| ***B65D 47/20*** | (2006.01) |
| ***B65D 53/02*** | (2006.01) |
| ***B65D 55/02*** | (2006.01) |
| ***B65D 85/72*** | (2006.01) |
| ***B67D 1/08*** | (2006.01) |
| ***B67D 1/12*** | (2006.01) |
| ***A47G 19/22*** | (2006.01) |
| *B67D 7/42* | (2010.01) |

(52) U.S. Cl.
CPC ..... *B65D 47/20* (2013.01); *B65D 53/02* (2013.01); *B65D 55/02* (2013.01); *B65D 85/72* (2013.01); *B67D 1/0894* (2013.01); *B67D 1/1272* (2013.01); *B67D 7/42* (2013.01); *B67D 2210/00065* (2013.01)

(58) Field of Classification Search
CPC .... B65D 85/72; B67D 1/0894; B67D 1/1272; B67D 2210/00065; B67D 7/0288; B67D 7/42
USPC ..... 141/113
See application file for complete search history.

(56) References Cited

U.S. PATENT DOCUMENTS

| | | | | |
|---|---|---|---|---|
| 2008/0223478 | A1* | 9/2008 | Hantsoo | B65D 1/265 141/2 |
| 2008/0302711 | A1* | 12/2008 | Windmiller | B65D 1/06 210/137 |
| 2011/0061764 | A1* | 3/2011 | Springer | A47G 19/2205 141/1 |

FOREIGN PATENT DOCUMENTS

| | | | |
|---|---|---|---|
| KR | 10-1243382 | 3/2013 | A47G 19/22 |
| KR | 20-2014-0001983 | 4/2014 | A47G 19/22 |
| KR | 10-2014-0059465 | 5/2014 | B65D 33/36 |
| WO | WO 2009/143164 A1 | 11/2011 | B65B 3/04 |

* cited by examiner

BEVERAGE CONTAINER FOR INJECTING BEVERAGE THROUGH BOTTOM THEREOF

This application is the national phase entry of international patent application no. PCT/KR2014/010904 filed Nov. 13, 2014 and claims the benefit of Korean patent application No. 10-2014-0085888, filed Jul. 9, 2014, the disclosures of which are incorporated herein by reference in their entirety.

TECHNICAL FIELD

The present invention relates to a beverage container for injecting beverages through the bottom thereof, and more particularly to a beverage container for injecting the beverages through the bottom thereof, which is capable of maximally maintaining the taste of a beverage by minimizing contact with air; and at the same time, excessive foam formation resulting from a head drop when pouring the beverages can be prevented by filling the beverage container with the beverages from the lower part of a receiving unit of the beverage container through an inlet disposed at the bottom of the beverage container when drinking liquid beverages such as beers.

BACKGROUND ART

Beverage is generally classified as an alcoholic beverage or a non-alcoholic beverage; beer, distilled liquor, and the like are alcoholic beverages, and cola, cider, and the like are non-alcoholic carbonated beverages.

First, as for beers, there are bottled beers or canned beers which are often manufactured in a factory and sold by large quantities; and there are draft beers that are being stored in a beer container at the sales places for serving the drinkers in a bar (pub).

Also, as for carbonated beverages, there are bottled beverages or canned beverages; and those are being supplied to fast food stores and the like as stored in a container in the form of a concentrated carbonated liquid solution, which is mixed with water and being served to the drinkers as stored in a beverage container.

A most commonly used beer cup, as an example of a container wherein beverages are being contained, comprises a transparent glass material or a synthetic resin product. Since a relatively large amount is poured in at a time for drinking, generally, beer cups which can contain 500 cc or 1000 cc of beer are widely used.

Such a beer cup of the prior art is configured in a way that the lower bottom thereof is closed and the upper side thereof is open so that beverages are poured in through the upper side opening.

Especially, draft beers are produced through the fermentation and ripening process of wort followed by just filtering thereof without undergoing the sterilization process, and such draft beers are provided through the draft beer supplying apparatuses.

A draft beer supplying apparatus of the prior art being used in the beer specialty store generally utilizes a method wherein a supplying tube is connected to a draft beer tank, and a draft beer is supplied to the beverage container by opening and closing of the tube path using a valve provided in the supplying tube.

Beer has a relatively lower alcohol concentration among the liquors and thus anybody can simply enjoy without an imposition; however, unlike other beverages, a draft beer is being supplied through a beverage supplying apparatus and poured into the beer cup through the opening in the upper portion thereof causing a large amount of foams due to the injection pressure, so there has been inconveniences in that the foams have to be removed every time after the beverage is injected into a container such as a beer cup and the like.

Thus, since draft beers are mostly being supplied from the upper side when being supplied to a beverage container using a draft beer supplying apparatus of the prior art, a large amount of foams are produced when the temperature is inappropriate causing wetting of clothes due to spillover, or undesirable in the aspects of sanitation; and moreover, there is a problem in that the taste of the draft beers are being degraded due to the excessive foams.

Furthermore, a conventional beer cup has a problem in that the taste of the beer is degraded due to oxidation thereof due to contact of the beer with air when pouring the beer, and such phenomenon becomes more significant when drinking a draft beer.

The amount of foams of draft beers can be appropriately maintained when the draft beers are being supplied after forming a hole in the bottom surface of the beverage container for solving the above described problems; however, there is a problem in that this method cannot be adopted since no adequate method is available for sealing the hole in the bottom of the beverage container after the draft beer has been injected via the hole.

Thus, there is a need for a beverage container capable of eliminating such problems.

As a technology for solving the above described problems, there is Korea Patent registered on Mar. 7, 2013 under No. 10-1243382 titled "Device for blocking inlet of beverage cup and manufacturing method the same" (hereinafter referred to as "prior art").

The prior art includes: an inlet which is penetratingly formed towards the inside and outside of the bottom of the beverage cup for supplying beverages inside the beverage cup through the nozzle of the beverage supplying apparatus; and a magnetic force blocking unit provided in the outer surface and the inner surface of the bottom of the beverage cup, and magnetically attached for sealing the inlet after the beverage is forcibly injected through the nozzle of the beverage supplying apparatus.

The above described prior art prevents the beverage from leaking towards the outside since the inlet is closed by the magnetic force blocking unit through magnetic force when the beverage injection is completed while the inlet is open.

However, since a magnetic force blocking unit having magnetic force and made of metallic material is used in the prior art, beverages may easily be in contact with the magnetic force blocking unit; and such contact may have a high risk of rust and the like which may spoil the beverages when the beverage cup is being used for a long time; thus, there is a problem in that the effectiveness is being degraded as a beverage container directly used for drinking by a human in the aspects of sanitary control and harmlessness to human body.

Especially, the adoption of the foresaid prior art requires a sealing technique for preventing the above mentioned magnetic force blocking unit from contacting with the beverages; such manufacturing method is not only unreasonable in the aspects of the manufacturability of the beverage cup, but also the manufacturing cost thereof will be increased; so there is a limitation in popularization of such beverage cup as a low cost consumable product.

SUMMARY OF INVENTION

Technical Problem

An objective of the present invention for solving the above described problems is to provide a beverage container for injecting beverages through the bottom thereof, wherein the amount of foams produced when injecting beverages such as beers into a beverage container such as a cup and the like can be properly adjusted, and the beverages are injected from the nozzle of the beverage supplying apparatus via the inlet formed in the bottom of the main body of the beverage container so as to maximally maintain the original taste of the beverages.

Another objective of the present invention is to provide a beverage container for injecting beverages through the bottom thereof wherein an injection hole formed in the bottom is stably opened only during beverage injection period; and the beverage injection is performed through the bottom comprising a holder being coupled to the inlet so as to block the leaking of the beverages through the injection hole in the bottom by completely sealing the injection hole after the beverage injection, and a bottom including a locking member elastically supporting the holder so as to be descended and close the inlet.

Yet another objective of the present invention is to provide a beverage container for injecting beverages through the bottom thereof which is convenient in that the holder closes the inlet always except during the beverage injection period so that the beverages are prevented from leaking out.

Still another objective of the present invention is to provide a beverage container for injecting beverages through the bottom thereof wherein a packing member is coupled to the upper wall body of the holder so that the beverage contained in the main body is completely prevented from leaking out through the gap between the holder and the bottom of the main body around the circumference of the inlet, and includes a seating portion where the packing member is being tightly contacted.

Still yet another objective of the present invention is to provide a beverage container wherein the closing operation of the inlet is stably performed through the elastic force of the elastic arm, and at the same time; and in order to facilitate manufacturing of the elastic arm of the locking member and reduce the manufacturing cost, the elastic arm is formed by cutting a portion of the body of the locking member and bending the cut portion upwardly, and the space remaining after the cutting is functioning as a receiving slot for accommodating the elastic arm being folded.

Solution to Problem

For achieving the above described objectives, a beverage container for injecting beverages through the bottom thereof according to the present invention is characterized in that and includes: a main body having an inlet penetratingly formed in the bottom of a receiving unit thereof; a holder, which is coupled to the inlet and opens and closes the inlet through ascending and descending thereof, wherein the nozzle of a beverage supplying apparatus is inserted; and a locking member which is coupled to the elevating wall body of the holder and has a plurality of elastic arms elastically and downwardly supporting the holder which are in contact with the lower surface of the bottom of the main body so that the holder can close the inlet.

The beverage container for injecting beverages through the bottom thereof according to the present invention is characterized in that wherein the holder is provided with a packing member coupled to the lower portion of the upper wall body and in contact with the bottom of the main body around the circumference of the inlet.

The beverage container for injecting beverages through the bottom thereof according to the present invention is characterized in that wherein the main body includes a seating portion which is formed of a partially recessed portion of the bottom around the circumference of the inlet for the packing member to be inserted into the seating portion and be tightly contacted on the seating portion The beverage container for injecting beverages through the bottom thereof according to the present invention is characterized in that the elastic arms is formed by cutting a portion of the body along a outer circumference of the center hole portion of the locking member and being upwardly bended for the elastic force of the elastic arms to be exerted, and the space remaining after cutting off a portion of the body of the locking member is functioning as a receiving slot for accommodating the elastic arm being folded when the holder is descending.

Advantageous Effects of Invention

A beverage container for injecting beverages through the bottom thereof according to the present invention may properly maintain the amount of foams produced when pouring beverages such as beers and the like since beverage injection is performed from the bottom by coupling the nozzle of the beverage supplying apparatus to the inlet formed in the bottom, and may provide best quality beverages by maximally maintaining the original taste of the beverages not allowing the beverages to be in contact with air and oxidized during pouring of the beverages.

Especially, the beverage container for injecting beverages through the bottom thereof according to the present invention is: convenient in use by adopting a holder and a locking member capable of automatically performing the opening and closing operation of the holder which is coupled to the inlet without requiring any separate operation when the main body of the beverage container is engaged and disengaged with the nozzle of the beverage supplying apparatus; harmless since the beverages are not exposed to and not in contacted with other components harmful to human by not requiring any separate elements (for example, magnets) and the like for the opening and closing operation of the holder; useful in that this new way of beverage injection can be utilized in marketing for a beer specialty store and the like; and very useful for popularization of the beverage container for injecting beverages in a unique way since the manufacturing of such beverage container is easy and it can be supplied with low price.

In addition, the beverage container for injecting beverages through the bottom thereof according to the present invention is capable of stably preventing the beverages from leaking out through the inlet in the bottom even when the beverage container is used for a long time by completely closing the inlet while enhancing the productivity of the manufacturing and assembling thereof; and more particularly, the beverage container for injecting beverages through the bottom thereof according to the present invention is advantageous for a long time usage since the failure and damage of the holder and the like can be minimized because the closing state of the inlet is maintained through the locking member having a structure wherein the holder is simplified.

Further, the beverage container for injecting beverages through the bottom thereof according to the present invention is capable of fundamentally blocking the leaking out of the beverage inside the main body by providing a packing member in the upper wall body of the holder since the gap between the holder and the bottom is sealed by the packing member under the state wherein the inlet is closed by the holder.

In addition, the beverage container for injecting beverages through the bottom thereof according to the present invention is easy to manufacture and may reduce the manufacturing cost since any separate element or structure and the like is not necessary in order to add an elastic member such as a spring and the like for automatic returning of the holder since the elastic arm is formed by cutting a portion of the body of the locking member and bending upwardly.

DESCRIPTION OF SYMBOLS OF THE MAIN PARTS IN THE DRAWINGS

Figure 1:
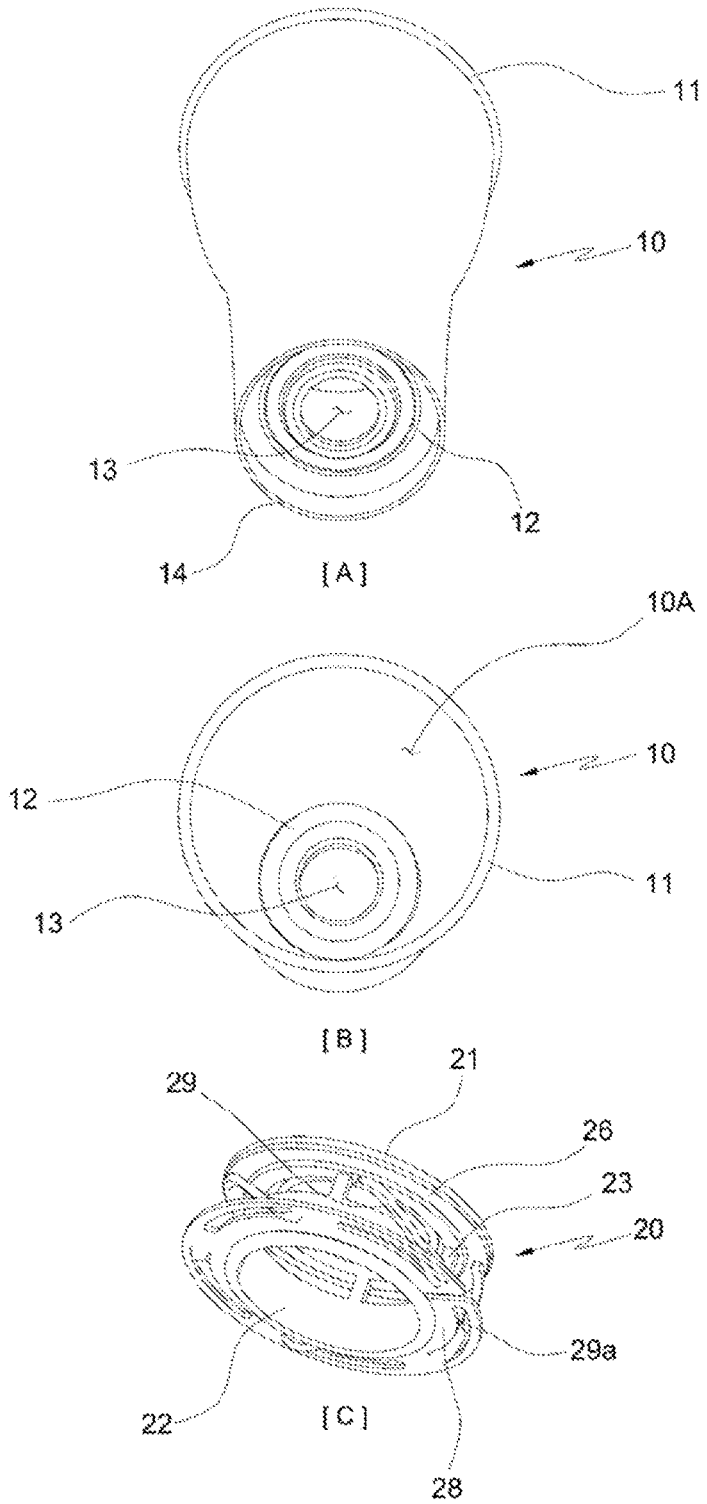
FIG. 1 is the perspective views of the individual elements of the beverage containers according to the present invention.

| | |
|---|---|
| 10: main body | 10A: receiving unit |
| 11: outer wall | 12: bottom |
| 13: inlet | 14: supporting wall body |
| 20: holder | 21: upper wall body |
| 22: elevating wall body | 23: connecting band |
| 24: injection portion | 26: packing member |
| 28: locking member | 29: elastic arm |
| 30: nozzle | 31: body |
| 33: O-ring | |

DETAILED DESCRIPTION OF EMBODIMENT

This invention may be variously modified and embodied in many different forms, and embodiments (or aspects) are to be specifically described herein. However, this invention should not be construed as limited to specific disclosure forms, and the spirit and scope of the invention should be understood as incorporating various modifications, equivalents and substitutions.

Wherever possible, the same reference numerals in the drawings, in particular, the reference numerals in which a two-digit number and one-digit number are the same or a two-digit number, one-digit number and letters of the alphabet are the same, will be used throughout the drawings and the description to refer to the same or like members. Unless otherwise stated, the members designated by respective reference numerals in the drawings are regarded as members based on such standards.

In the drawings, the sizes or thicknesses of elements are expressed excessively large (or thick) or small (or thin) or in simplified form for convenience of understanding, however, this should not be interpreted as limiting the scope of protection of the claims of this invention.

The terminology used herein is for the purpose of describing particular embodiments only and is not intended to be limiting. As used herein, the singular forms are intended to include the plural forms as well, unless the context clearly indicates otherwise.

It will be further understood that the terms "comprises" and/or "comprising," or "includes" and/or "including" when used in this specification, specify the presence of stated features, numbers, steps, operations, elements, components or combinations thereof, but do not preclude the presence or addition of one or more other features, numbers, steps, operations, elements, components or combinations thereof.

Unless otherwise defined, all terms used herein, including technical or scientific terms, have the same meanings as those generally understood by those with ordinary knowledge in the field of the art to which the present invention belongs. Such terms as those defined in generally used dictionaries and are to be interpreted as having meanings equivalent to the contextual meanings in the relevant field of art, and are not to be interpreted as having ideal or excessively formal meanings unless clearly defined as having such in the present application.

It will be understood that the terms first, second, etc. may be used herein to describe different elements, and the sequence of formation thereof does not matter. These terms may be differently described in the detailed description and the claims of the invention.

Figure 2A:
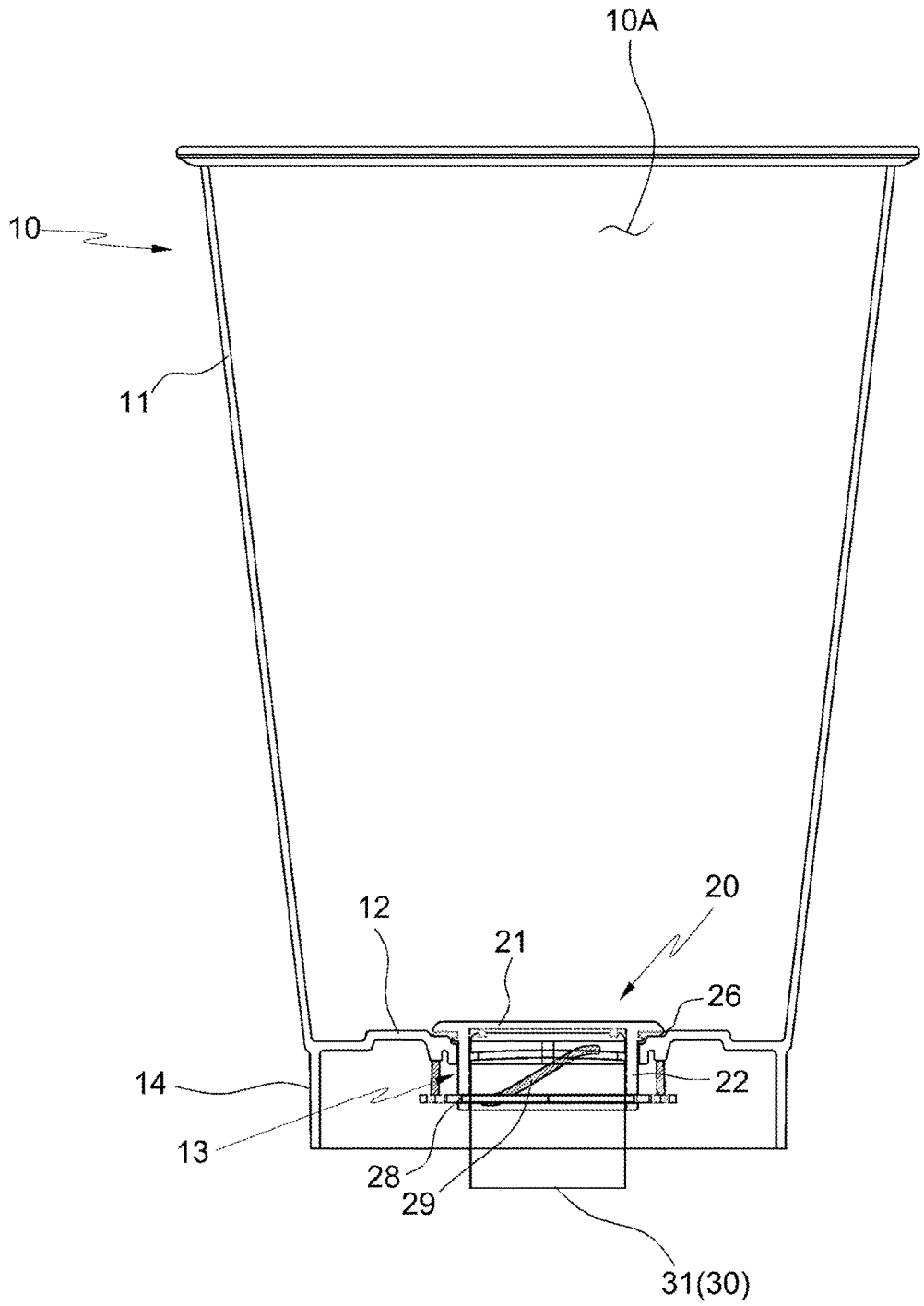
FIGS. 2*a* and 2*b* are the cross-sectional views illustrating the combined states of the beverage containers according to the present invention.

For explaining a beverage container according to the present invention, for the convenience's sake, the approximate reference directions are specifically defined with reference to FIG. 2*a*; that is, direction of gravity is defined as a 'downward direction' which is the reference direction; and up, down, left, and right directions are defined with respect to this reference direction as viewed from user.

Especially in FIG. 2*a*, the inner and the outer sides are defined in a way that the inner side is defined as the direction pointing towards the center of the inlet 13, and the outer side is defined as the direction pointing the opposite direction; unless otherwise mentioned, directions will be specified and described based on this reference throughout the detailed description of embodiments and claims of the present invention in relation to the other drawings.

Hereinafter, a beverage container for injecting beverages through the bottom thereof according to the present invention will be described with reference to the accompanying drawings.

First, as illustrated in FIGS. 1 to 5, a beverage container according to the present invention mainly includes: a main body 10 which has a receiving unit 10A wherein the beverages are injected and received and an inlet 13 is formed in the bottom 12 of the receiving unit 10A; a holder 20 which is coupled to the inlet 13 of the main body 10 and opens and closes the inlet 13; and a locking member 28 which closes the inlet 13 by descending the holder 20 and maintains the state of closing.

Figure 2B:
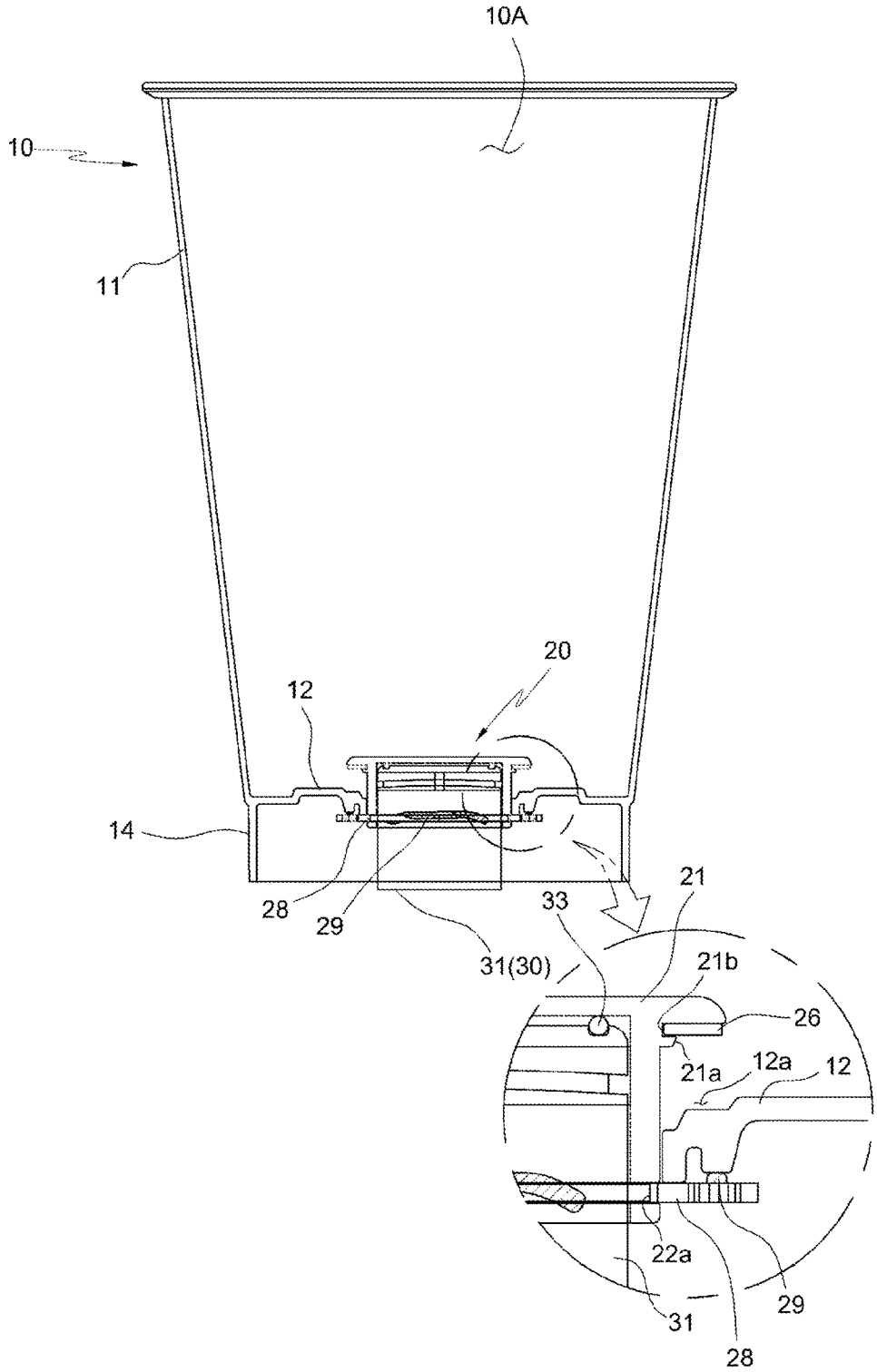

As illustrated in FIGS. 1, 2*a*, and 2*b*, the main body 10 having the shape of a common cup (glass) comprises a receiving unit 10A surrounded by the outer wall 11, and the upper portion of the receiving unit 10A is open, and the an inlet 13 is penetratingly formed in the center of the bottom 12 of the receiving unit 10A.

Although the main body 10 illustrated in the drawing is illustrating the shape of the most common type glass (cup) as a representative, it is not limited to this and may be modified to a beer cup like a beer jug having a wide opening and provided with a handle (not shown) at one side of the outer wall 11 or a pitcher (not shown) wherein a large amount of beverages are filled.

Preferably, the main body 10 of the present invention is formed with a supporting wall body 14 along the outer circumference of the bottom 12 so that the beverage container can be stably erected on a common table or on the nozzle portion of the beverage supplying apparatus.

The main body 10 is made of a glass or synthetic resin material such as plastics and the like; although it can be made of a transparent or an opaque material, it is preferred to be made of a transparent material.

As illustrated in FIGS. 2 to 5, the holder 20 being coupled to the inlet 13 includes: an upper wall body 21 covering the inlet 13; an elevating wall body 22 being coupled to the inlet 13 wherein a nozzle 30 of the beverage supplying apparatus (not shown) is inserted and so that the up-down movement of the holder 20 is ensured; and a connecting band 23 which connects the upper wall body 21 and the elevating the elevating wall body 22.

The connecting bands 23 comprise a plurality of connecting bands 23 so as to connect the upper wall body 21 and the elevating wall body 22, and an injection portion 24 is formed between the connecting bands 23 so that the beverages can be injected into the receiving unit 10A of the main body 10 through the nozzle 30.

The holder 20 is formed by injection molding with a synthetic material such as a plastic and the like and prevents deterioration due to the contact with the beverages; furthermore, it also can be manufactured with the packing member 26, which will be described later, through the dual injection molding method.

The elevating wall body 22 of the holder 20 is coupled to the inlet 13, so that when the inlet 13 of the main body 10 is coupled to or separated from the nozzle 30 of the beverage supplying apparatus, the inlet 13 is opened and closed respectively as the holder 20 is ascending and descending.

That is, when the main body 10 is coupled to the nozzle 30, the nozzle 30 elevates the holder 20 so that the injection portion 24 communicates with the receiving unit 10A as the inlet 13 is opened, and thus, the beverages discharged from the nozzle 30 is being filled from the lower side of the receiving unit 10A, that is, the bottom 12 of the main body 10 towards the upper side;

when the main body 10 is separated from the nozzle 30, the locking member 28 descends the holder 20 so that the closed state of the inlet 13 is maintained, and thus, the beverages inside the receiving unit 10A is prevented from leaking out from the lower side.

At this time, the upper portion of the body 31 of the nozzle 30 is provided with water-tightness between the upper wall body 21 and the upper end portion of the body 31 due to the O-ring 33, which will be described later; and the discharging outlet 31A, through which the beverage is discharged, is formed along the outer circumferential surface of the body 31, and thus it has a structure communicating with the supplying tube portion (not shown) wherein the beverage is transported.

Figure 3:
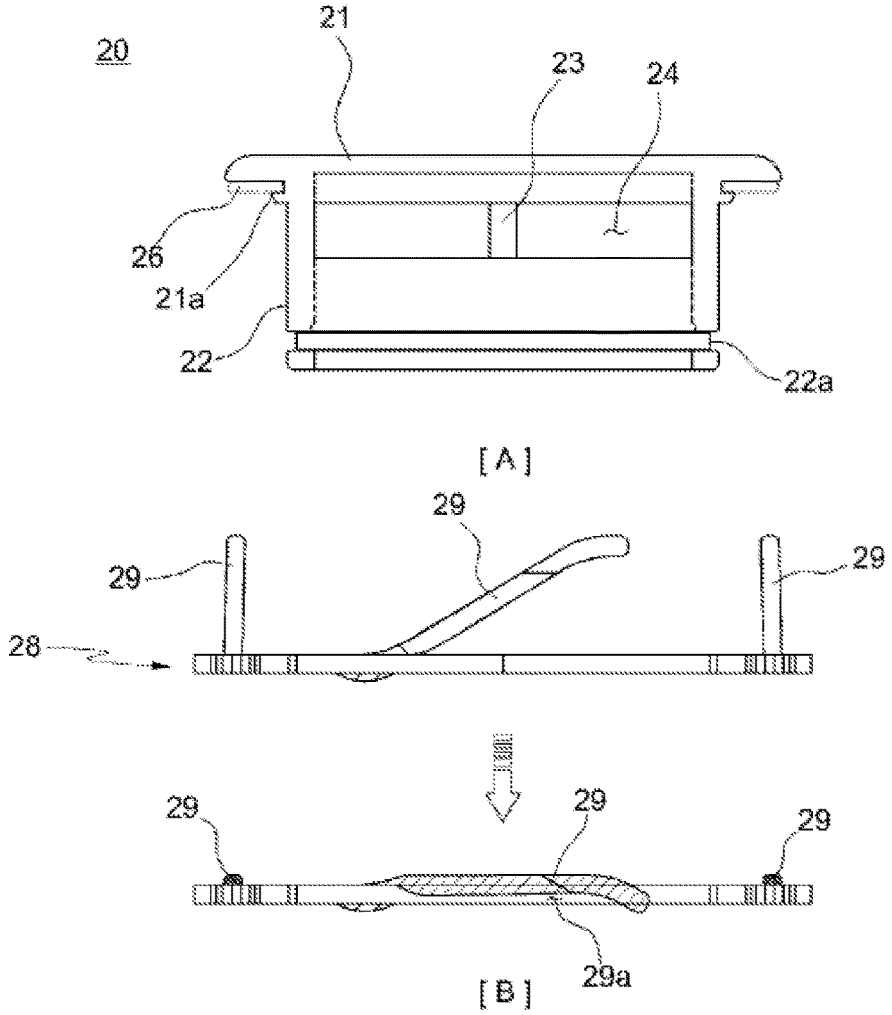
FIGS. 3 to 5 are the exploded cross-sectional views of main parts of the beverage containers according to the present invention.

In addition, as illustrated in FIGS. 2*b* and 3, a supporting protrusion 21*a* outwardly protruded is provided in the lower portion of the upper wall body 21 of the holder 20, thus a coupling slot 21*b* is formed between the supporting protrusion 21*a* and the upper wall body 21, and since the packing member 26 is forcibly coupled to the coupling slot 21*b* (It also can be manufactured by dual injection molding method with the holder 20), when the inlet 13 is closed as the holder 20 is descended the water-tightness is assured due to the contact of the packing member 26 with the upper surface of the seating portion 12*a* in the circumference of the inlet 13.

Figure 4:
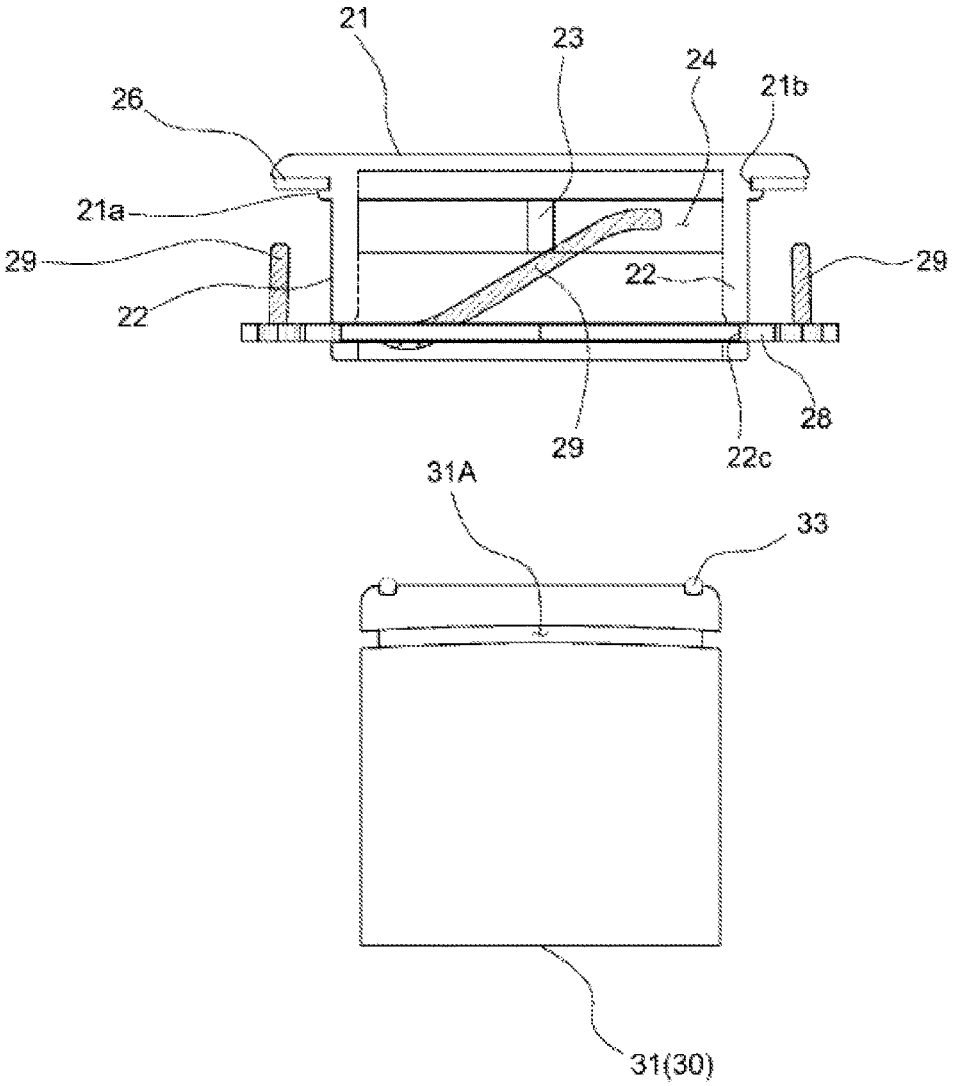
Figure 5:
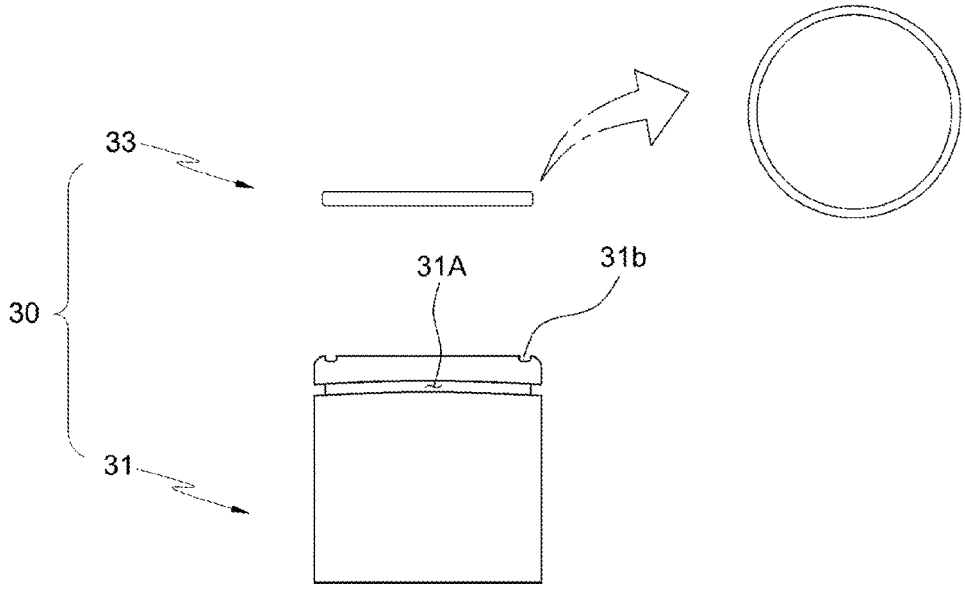

Next, as illustrated in FIGS. 3 and 4, the locking member 28 is coupled to the elevating wall body 22 of the holder 20 and it is in contact with the lower surface of the bottom 12 of the main body 10 so as to be closed when the holder 20 is descended, and provided with a plurality of elastic arms 29 which elastically support the holder 20.

The locking member 28 is a member having a ring shaped body which is coupled to the coupling slot 22*a* provided along the outer circumferential surface of the holder 20, wherein a center hole portion where the elevating wall body 22 can pass through is penetratingly formed in the center of the body of the locking member 28; the end portion of the elastic arm 29 is in contact with the lower surface of the bottom 12 of the main body 10, while the holder 20 is coupled to the inlet 13 of the main body 10 as the elastic force of the elastic arm 29 is vertically exerted when a portion of the body is cut along the outer circumference of the center hole portion and upwardly bended; and the remaining space after a portion of the body of the locking member 28 is cut off due to the forming of the elastic arm 29 is functioning as a receiving slot 29*a* for accommodating the elastic arm as it is being folded.

Thus, as illustrated in FIGS. 2 to 4, the 'assembly of the holder 20 and the locking member 28' is coupled to the inlet 13 of the main body 10;

when the main body 10 is separated from the beverage supplying apparatus, the locking member 28 downwardly presses the holder 20 due to the elastic force of the elastic arm 29, thus the closed state is maintained with the holder 20 descended;

when the main body 10 is coupled to the beverage supplying apparatus, as the 'assembly of the holder 20 and the locking member 28' is ascended due to the pressure of the nozzle 30 the elastic arm 29 is folded and inserted in the receiving slot 29*a*, thus the open state is maintained with the holder 20 ascended.

In this case, when the 'assembly of the holder 20 and the locking member 28' is ascended, the elastic arm 29 of the locking member 28 is contacted to the lower surface of the bottom 12 of the main body 10 and being downwardly folded, and the body of the locking member 28 is contacted to the lower surface of the bottom 12 therefore the separation of the holder 20 towards the receiving unit 10A is prevented;

when the 'assembly of the holder 20 and the locking member 28' is descended, since the packing member 26 coupled to the upper wall body 21 of the holder 20 is contacted to the upper surface (seating portion 12*a*: refer to the exploded cross-sectional view of FIG. 2*b*) of the bottom 12 of the main body 10, the separation of the holder 20 from the inlet 13 and from the main body 10 is prevented thereby.

At this time, the seating portion 12*a* where the packing member 26 is being contacted is formed by downwardly recessing a portion of the bottom 12 around the circumference of the inlet 13 of the main body 10 so that the gap occurring between the bottom 12 is completely closed since the packing member 26 is closely contacted to the seating portion 12*a*, thereby preventing the beverage from leaking out towards the outside.

Especially, the present invention is easy to manufacture and its manufacturing cost can be reduced since the elastic arm 29 is formed by cutting a portion of the body of the locking member 28 and upwardly bended and fixed so that the elastic force of the elastic arm 29 is vertically exerted, and accordingly, it is manufactured in a way that the elastic arm 29 is received passing through the receiving slot 29*a* which is formed when the elastic arm is bended, therefore any separate element or structure and the like is not necessary in order to add a separate elastic member such as a spring and the like.

And, a second mounting slot 31*b* is formed in the upper end portion of the body 31 of the nozzle 30, and an O-ring 33 is coupled to the second mounting slot 31*b*, thereby resolving the impact resulting from the contact with the lower surface of the upper wall body 21 of the holder 20.

Furthermore, the present invention has a structure wherein a discharging outlet 31A of the nozzle 30 is formed along the outer circumference of the body 31 so that the beverage is exhausted and discharged in radial direction, therefore, unlike the structure wherein the beverage is discharged through the upper end portion of the body 31, the holder 20 is prevented from separating upwardly from the inlet 13 due to discharging pressure; and especially, the beverage injected through the O-ring 33 is prevented from flowing in through the surface where the upper wall body 21 and the body 31 meet so that the separation of the holder 20 from the inlet 13 due to the beverage discharging pressure is completely blocked.

As described heretofore, the beverage is injected from the lower portion of the beverage container of the present invention, therefore the beverage storage tank and the connecting structure of the beverage supplying apparatus of the present invention is almost same as those of the prior art provided with the nozzle 30 except that the nozzle is provided upright inversely towards the upper direction unlike that of the prior art; and thus, the description of the detailed configuration of the beverage supplying unit is omitted in this specification since it less relevant to the fundamental essence of the present invention.

Furthermore, in describing the present invention, although mainly a beverage container for injecting the beverages through the bottom thereof having a specific shape and structure is described with reference to the accompanying drawings, the present invention can be diversely modified, altered, and substituted by a person skilled in the art; and it should be interpreted as such modifications, alterations, and substitutions belong to the scope of the protection of the present invention.

The invention claimed is:

1. A beverage container comprising:

a main body having an inlet penetratingly formed in the bottom of a receiving unit thereof;

a holder, which is coupled to said inlet and opens and closes said inlet through ascending and descending thereof, wherein a nozzle of a beverage supplying apparatus is inserted; and a locking member which is coupled to an elevating wall body of said holder and has a plurality of elastic arms elastically and downwardly supporting said holder which are in contact with the lower surface of said bottom of said main body so that said holder can close said inlet, wherein said elastic arms are formed by cutting a portion of the body along an outer circumference of the center hole portion of said locking member and being upwardly bended for the elastic force of said elastic arms to be exerted, and the space remaining after cutting off said portion of said body of said locking member is a receiving slot for accommodating said elastic arm being folded when said holder is descending.

2. The beverage container according to claim 1, wherein said holder is provided with a packing member which is coupled to the lower portion of the upper wall body of said holder and in contact with said bottom of said main body around the circumference of said inlet.

3. The beverage container according to claim 2, wherein said main body includes a seating portion which is formed of a partially recessed portion of said bottom around said circumference of said inlet for said packing member to be inserted into said seating portion and be tightly contacted on said seating portion.

4. The beverage container according to claim 1, wherein said holder being coupled to said inlet includes:

an upper wall body covering said inlet;

said elevating wall body being coupled to said inlet wherein said nozzle of said beverage supplying apparatus is inserted and so that the up-down movement of said holder is ensured; and a plurality of connecting bands which connect said upper wall body and said elevating wall body, wherein an injection portion is formed between the connecting bands.

5. The beverage container according to claim 2, wherein said holder being coupled to said inlet includes:

an upper wall body covering said inlet;

said elevating wall body being coupled to said inlet wherein said nozzle of said beverage supplying apparatus is inserted and so that the up-down movement of said holder is ensured; and a plurality of connecting bands which connect said upper wall body and said elevating wall body, wherein an injection portion is formed between the connecting bands.

6. The beverage container according to claim 3, wherein said holder being coupled to said inlet includes:

an upper wall body covering said inlet;

said elevating wall body being coupled to said inlet wherein said nozzle of said beverage supplying apparatus is inserted and so that the up-down movement of said holder is ensured; and a plurality of connecting bands which connect said upper wall body and said elevating wall body, wherein an injection portion is formed between the connecting bands.

* * * * *